US005225818A

United States Patent [19]

Lee et al.

[11] Patent Number: 5,225,818

[45] Date of Patent: Jul. 6, 1993

[54] DATA ENTRY CONTROL PANEL

[75] Inventors: Weng-Kai K. Lee, Boulder; David A. Rivera, Firestone; Kevin M. Myles, Ft. Collins; H. Michael Berman, Nederland; Paula C. Willis, Boulder, all of Colo.

[73] Assignee: Data Entry Products, Incorporated, Loveland, Colo.

[21] Appl. No.: 617,991

[22] Filed: Nov. 26, 1990

[51] Int. Cl.[5] ..... G09G 3/02

[52] U.S. Cl. ..... 340/711; 340/762; 340/784; 200/313; 200/314

[58] Field of Search ..... 200/313, 314, 317, 512, 200/513; 340/711, 762, 784

[56] References Cited

U.S. PATENT DOCUMENTS

| | | | |
|---|---|---|---|
| 2,953,668 | 9/1960 | Bassett, Jr. | 200/313 |
| 3,967,084 | 6/1976 | Pounds | 200/275 |
| 4,042,439 | 8/1977 | Pounds | 156/292 |
| 4,085,306 | 4/1978 | Dunlap | 200/275 |
| 4,168,122 | 9/1979 | Levin | 355/113 |
| 4,195,210 | 3/1980 | Pounds | 200/159 |
| 4,262,182 | 4/1981 | Basler et al. | 200/314 |
| 4,288,672 | 9/1981 | Puccini | 200/314 |
| 4,352,968 | 10/1982 | Pounds | 200/302 |
| 4,449,024 | 5/1984 | Stracener | 200/314 |
| 4,493,958 | 1/1985 | Hamilton et al. | 200/314 |
| 4,670,633 | 6/1987 | Kaiwa et al. | 200/314 |
| 4,740,165 | 4/1988 | Tomino et al. | 340/711 |
| 4,779,166 | 10/1988 | Tanaka et al. | 362/84 |
| 4,786,767 | 11/1988 | Kuhlman | 200/5 |

FOREIGN PATENT DOCUMENTS

WO8504280 9/1985 PCT Int'l Appl. ..... 200/314

*Primary Examiner*—Ulysses Weldon
*Assistant Examiner*—Amare Mengistu
*Attorney, Agent, or Firm*—Myers & Associates

[57] ABSTRACT

The thin section data display control panel of the present invention includes a graphic overlay, a diffuser block affixed to the graphic overlay and light emitting diodes surface mounted on a printed circuit board for providing localized sources of light to be transmitted through the diffuser block to the overlay. The graphic overlay is generally opaque, but has translucent areas through which the illumination shines. An overlay reflective portion on a diffuser side of the overlay reflects light back into the diffuser, except in areas adjacent to the translucent areas of the overlay. The diffuser block is affixed to the graphic overlay and is generally transparent for transmitting the light from the light emitting diodes. Block reflective surfaces on the perimeter edges of the diffuser block prevent light from exiting through the edges. Matte surfaces of the diffuser block adjacent the graphic overlay and adjacent the printed circuit board scatter the light transmitted from the light emitting diodes. The light emitting diodes provide a plurality of localized sources of light which is scattered within the diffuser block and thereby provide relatively uniform back lighted illumination to the translucent portions of the graphic overlay. The light emitting diodes are partially received within a recessed portion of the diffuser block. An electrostatic discharge shield, adjacent the printed circuit board, having a reflective metallic surface reflects light not transmitted through the translucent portions back into the diffuser block.

21 Claims, 5 Drawing Sheets

DATA ENTRY CONTROL PANEL

FIELD OF THE INVENTION

This invention relates to data entry control panels and in particular relates to thin section back lighted data entry control panels.

BACKGROUND OF THE INVENTION

Data entry control panels have long been known and typically employ a plurality of switches with an indicator to allow the entry of data or commands and the display of varying status of associated parameters.

Some data entry control panels employ dome switches such as the following listed patents owned by the assignee of the present invention and incorporated by reference herein:

U.S. Pat. No. 3,967,084 issued to Walter R. Pounds on Jun. 29, 1976 describing KEYBOARD SWITCH ASSEMBLIES HAVING TWO FOOT SUPPORT LEGS ON DOME-SHAPED CONTACT MEMBER.

U.S. Pat. No. 4,042,439 issued to Walter R. Pounds on Aug. 16, 1977 describing a METHOD OF MAKING KEYBOARD ASSEMBLIES.

U.S. Pat. No. 4,085,306 issued to Bill D. Dunlap on Apr. 18, 1978 describing KEYBOARD SWITCH ASSEMBLIES.

U.S. Pat. No. 4,195,210 issued to Walter R. Pounds et al on Mar. 25, 1980 describing SWITCHING ASSEMBLIES.

U.S. Pat. No. 4,352,968 issued to Walter R. Pounds on Oct. 5, 1982 describing an ELASTOMERIC BOOT FOR A KEYBOARD SUBASSEMBLY.

Back lighted control panels are also old. When a control panel is back lighted it is difficult to achieve adequate illumination over the entire surface of the panel, while avoiding undesirable glare in portions of the panel. Some skilled in the art were of the opinion that a functioning control panel could not be built having a thin section less than about one-half inch.

SUMMARY OF THE INVENTION

The thin section data display control panel of the present invention includes a graphic overlay, a diffuser block affixed to the graphic overlay and an illumination assembly for providing localized sources of light to be transmitted through the diffuser block to the overlay. The graphic overlay is generally opaque, but has translucent areas through which the illumination shines. An overlay reflective portion on a diffuser side of the overlay reflects light back into the diffuser, except in areas adjacent to the translucent areas of the overlay. The diffuser block is affixed to the graphic overlay and is generally transparent for transmitting the light from the illumination assembly. A matte diffusing surface of the diffuser block adjacent to the graphic overlay scatters the light transmitted from the illumination assembly. The illumination assembly provides a plurality of localized sources of light which is scattered within the diffuser block and thereby provide relatively uniform back lighted illumination to the translucent portions of the graphic overlay.

DETAILED DESCRIPTION OF THE DRAWING

Figure 1:
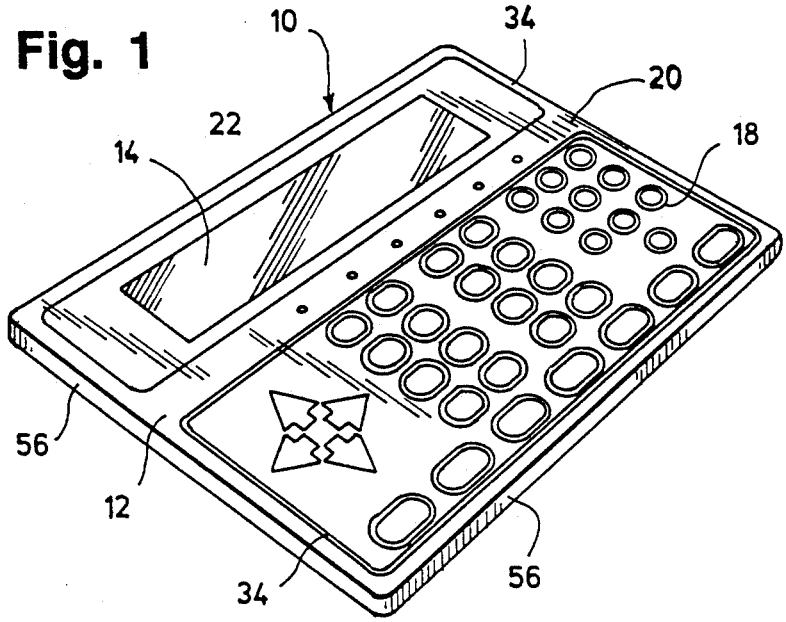
FIG. 1 is a perspective view of the data display control panel of the present invention.
Figure 2:
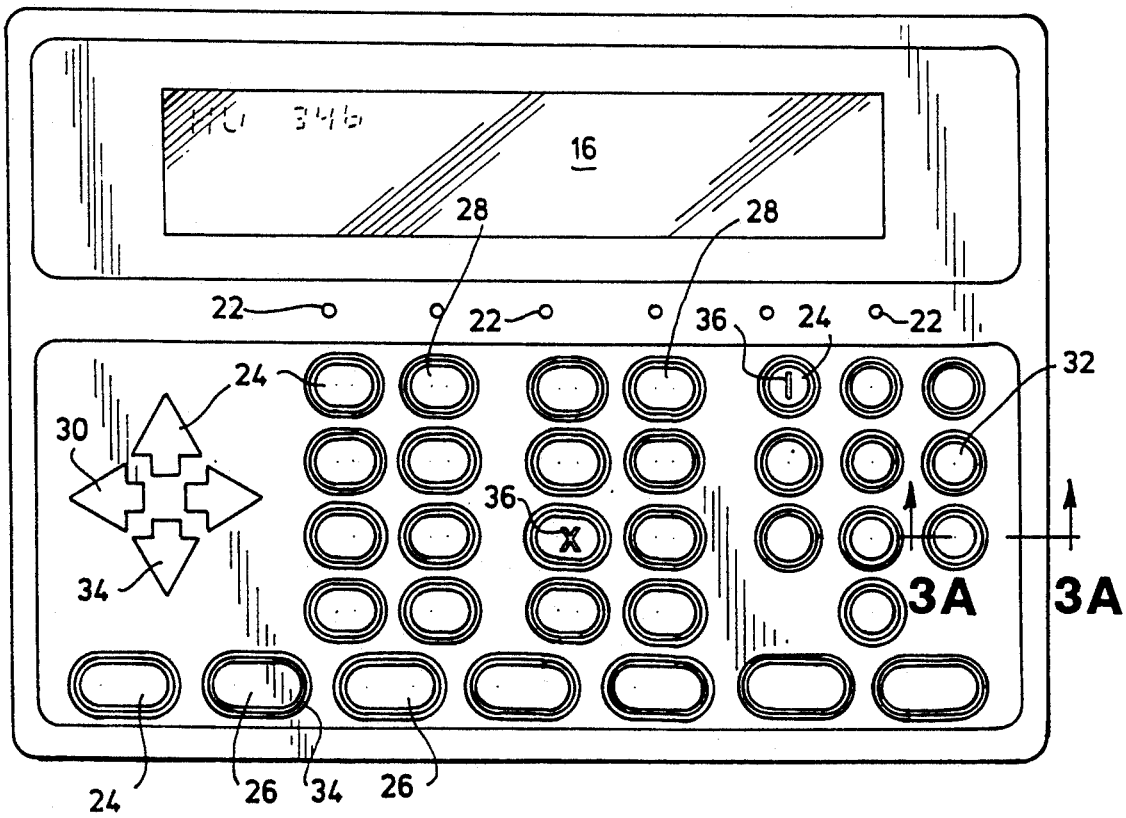
FIG. 2 is a top elevation of the data display control panel shown in FIG. 1.
Figure 3:
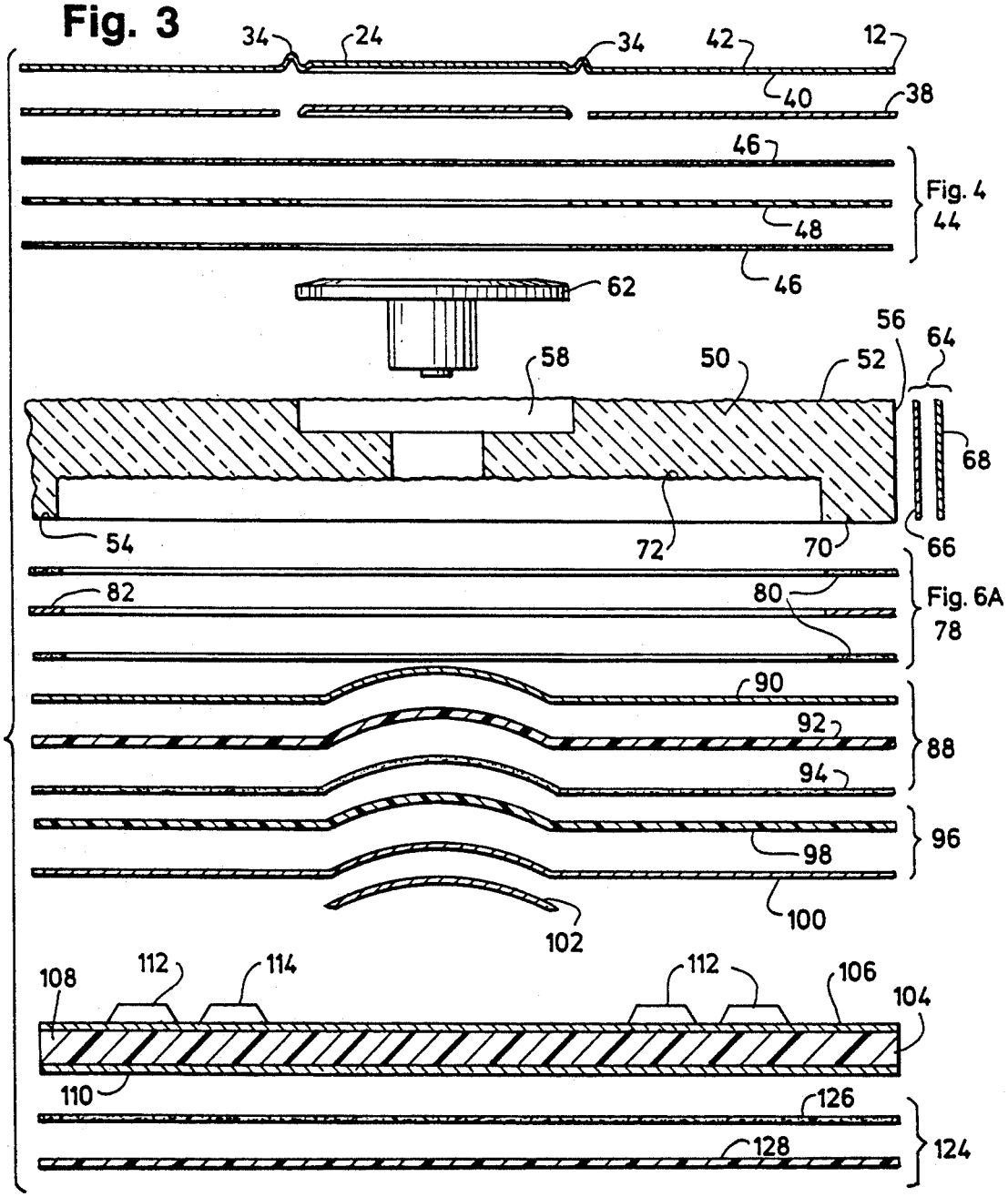
FIG. 3 is an exploded view of a portion of the data display control panel shown in FIG. 2.

FIG. 1 is a perspective view of the data display control panel of the present invention 10. Panel 10 has as its top component a graphic overlay 12 which includes a transparent portion 14 through which an associated liquid crystal display assembly 16 may be read, a key pad area 18 and a status display area 20. Status display area 20 includes a plurality of status LED's 22 each of which indicate a condition to be monitored. Key pad area 18 includes a variety of key pads 24 including function key pads 26, alphabetic key pads 28, cursor key pads 30 and numeric key pads 32. Overlay 12 is generally opaque but includes, in addition to transparent portion 14, a variety of translucent portions 34. Typically, translucent portions 34 serve as borders of key pads 34, or key pad area 18, or transparent portion 14. Translucent portions 34 also serve as key legends 36 and legends associated with status LED's 22. Panel 10 of the present invention has relatively uniform illumination without glare or bright spots in an exceptionally thin section approximating three tenths of an inch which is achieved by cooperation among its various components best generally illustrated in FIG. 3 of the Drawing.

Graphic overlay 12 is typically made of polycarbonate and is about seven thousands of an inch thick. An overlay reflective portion 38 is placed to a diffuser side 40 of overlay 12. Reflective portion 38 is not present near translucent portions 34. Reflective portion 38 is preferably an aluminum pigment ink applied on a vinyl chloride acrylic copolymer solution when wet. When the ink dries it provides a reflective surface preventing the transmission of light, except in the translucent areas 34 and reflecting light so that it cannot be viewed through overlay 12 from a distal side 42 of the overlay. An overlay adhesive 44 is applied to the bottom of reflective portion 38. Overlay adhesive 44 is an SCOTCH TM roll laminated high performance acrylic adhesive which is double sided, namely model 467MP. It includes adhesive layers 46 to either side of a plastic film 48 believed to be MYLAR. Overlay adhesive 44 affixes graphic overlay 12 to diffuser block 50.

Diffuser block 50 is generally transparent and preferably fabricated from polycarbonate. Block 50 has a graphic side 52, an illumination side 54 and perimeter edges 56 joining sides 52,54. Block 50 defines a plurality of communication orifices 58 and a LCD window 60. LCD window 60, as its name implies, partially receives liquid crystal display assembly 16. Communication orifices 58 serve a variety of purposes including receiving switch plunger 62, providing ports for status display LED's 22, and fastener holes for nuts and bolts 65 shown in phantom in FIG. 3*a*. Those communication orifices 58 which receive switch plunger 62, plunger holes 63 are stepped to positively locate plunger 62 and limit its travel. Plunger 62 is transparent polycarbonate to facilitate illumination of translucent portions 34 bordering key pads 24 and key legends 36. Block 50 includes block reflective surface 64 being at least a semi reflective coating adjacent perimeter edges 56. Block reflective surface 64 is preferably formed from a white ink 66 and a black ink 68. White ink 66 has titanium dioxide as a pigment. Black ink 68 has carbon black as a pigment. Inks 66 and 68 are also vinyl chloride acrylic copolymers. These inks are available from Naz-Dar, Inc. of Chicago under their parts numbers GV111, GV187 and GV122. Illumination side 54 of block 50 includes base portion 70 and recessed portion 72. Recessed portion 72 is about 0.060 inches closer to graphic side 52 than is base portion 70. The entire graphic side 52 is shown irregularly as is recessed portion 72 of illumination side 54. The irregularity indicates that each is a matte diffusing surface to promote the diffusion of light to be transmitted through and from block 50. The matte surfaces can be formed by roughening the surfaces with sand paper, preferably sand paper having an appropriate grit. It is believed that a standard fine grit of about 220 grit is adequate. Other means to diffuse light would probably be acceptable. Base portion 70 generally follows perimeter edges 56 to include base perimeter portions 74. Base portions 70 further includes base key portions 76 forming peninsulas from said base perimeter portions 74. Base key portions 76 assist in resisting vertical deflection of block 50 when key pads 24 are depressed. Double sided block adhesive 78 is affixed to the bottom of illumination side 54 of diffuser block 50.

Figure 4:
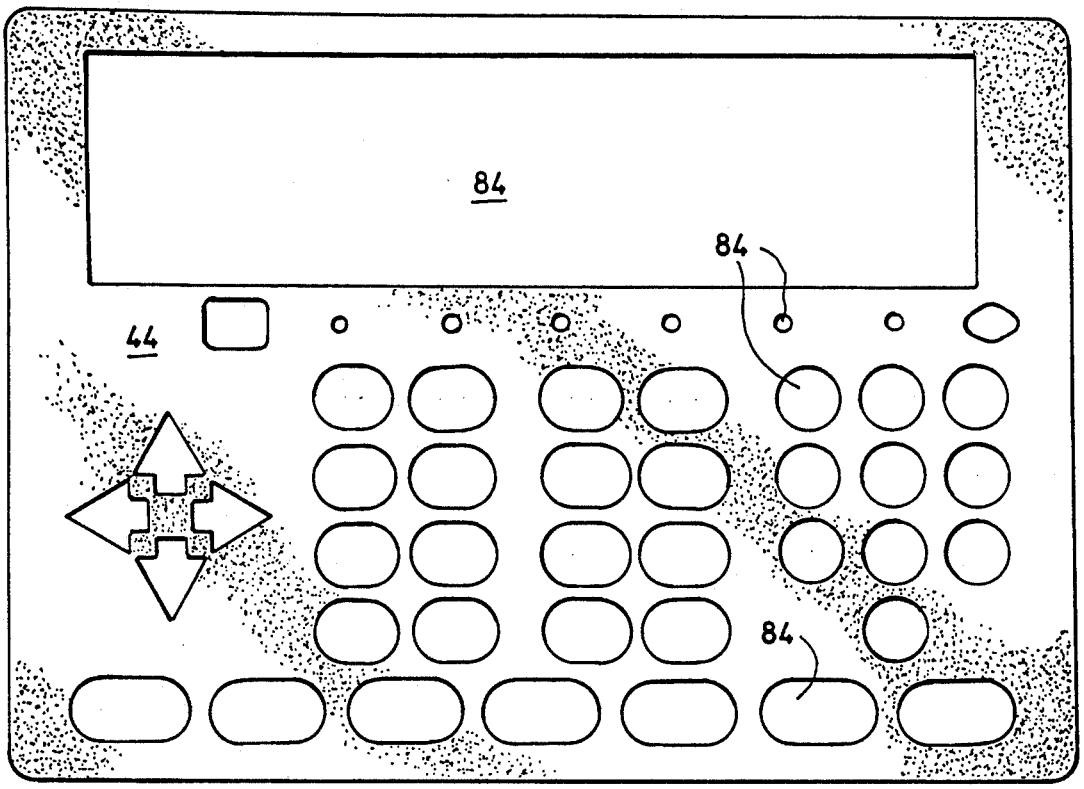
FIG. 4 is a top elevation of an overlay adhesive shown in FIG. 3.
Figure 5:
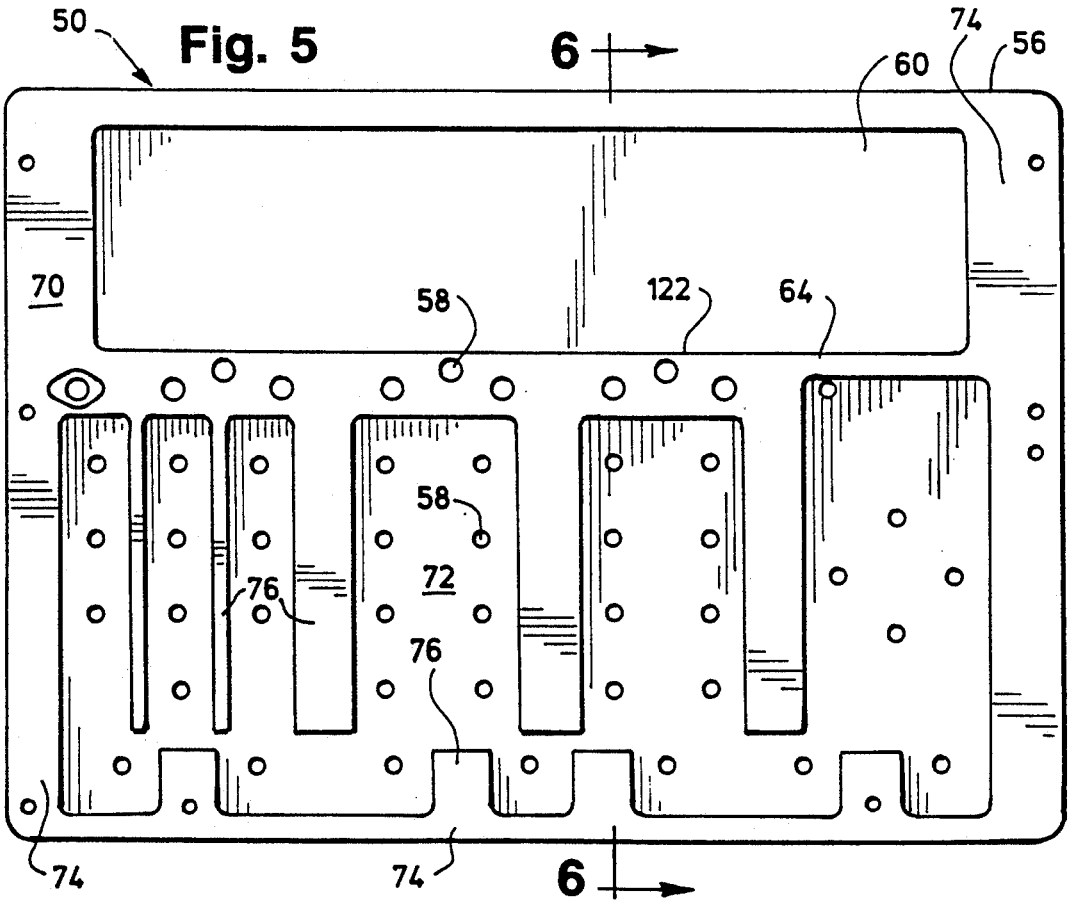
FIG. 5 is a bottom view of a diffuser block shown in FIG. 3.
Figure 6:
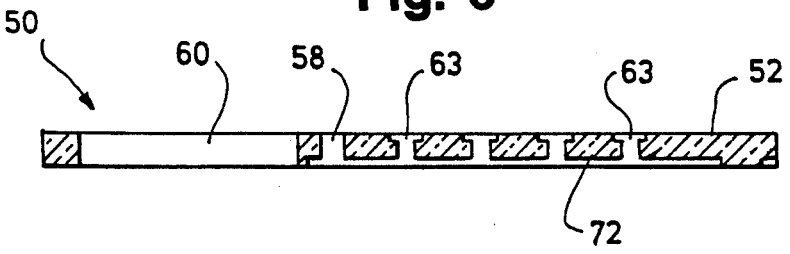
FIG. 6 is a cross section view along the lines 6—6 of FIG. 5.
Figure 6A:
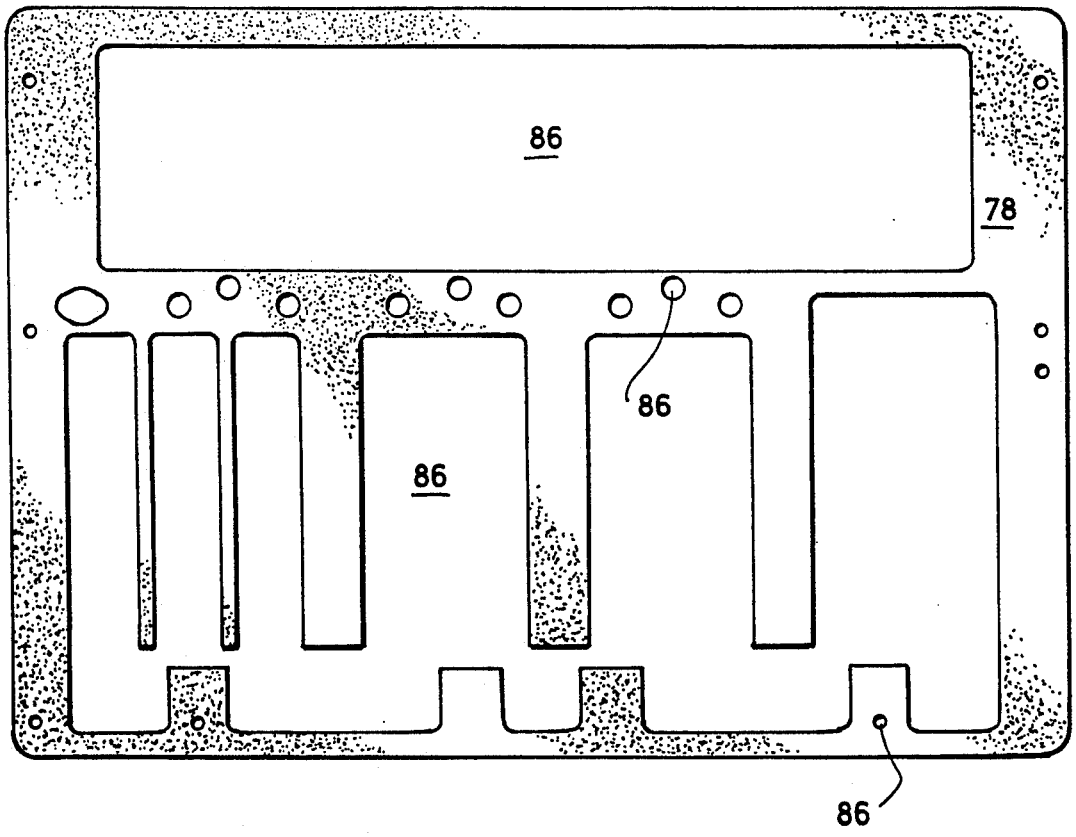
FIG. 6*a* is a bottom view of a block adhesive shown in FIG. 3.

Block adhesive 78 includes adhesive layers 80 to either side of a plastic film 82, believed to be MYLAR. Block adhesive 78 is also a Scotch TM roll laminated high performance acrylic adhesive, namely model 468MP. In addition to having a thicker layer of adhesive than overlay adhesive 44 (5 mil vs. 2 mil), block adhesive 78 is excised from different areas of panel 10. Overlay adhesive 44 is excised in excised areas 84. Excised areas 84 generally align with status display LED's 22, key pads 24 and transparent portions 14 as shown in FIG. 4. As shown is FIG. 6*a*, block adhesive 78 generally follows base portions 70 having excised areas 86 which align with LCD window 60 and communication orifices 58. Block adhesive 78 causes block 50 to adhere to electrostatic discharge shield 88 below it.

Electrostatic discharge shield 88 includes three layers; a top layer of aluminum foil 90, polyester film 92 and acrylic adhesive layer 94 to the bottom. Electrostatic discharge shield 88 is available as Electroshield product number of A-20P.S. sold by Lamart Corporation of Clifton, N.J. Acrylic adhesive 94 causes electrostatic discharge shield 88 and components above it to adhere to domeseal 96 below it.

Domeseal 96 includes plastic film 98 and adhesive layer 100 below it. Domeseal 96 fixes dome switch contact 102 to printed circuit board 104 in registration with front (or top) foil 106. Printed circuit board 104 further includes substrate 108 and bottom foil layer 110.

Printed circuit board 104 further supports a plurality of relatively wide dispersion light emitting diodes 112.

Figure 3A:
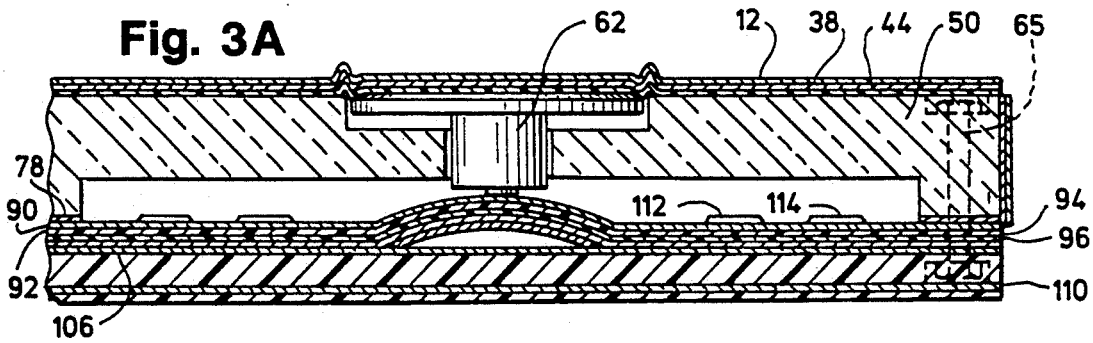
FIG. 3*a* is a cross section along the lines 3*a*—3*a* of FIG. 2.

Preferably light emitting diodes 112 have a half angle off axis intensity at which luminous intensity emitted by each, falls to one half the axial intensity of about seventy degrees and have a luminous intensity of about two milli-candela (2 mcd). They are preferably surface mounted to printed circuit board 104. LITE-ON type SOT-23 surface mount LED lamps model LTL-970YK (yellow) serve admirably for light emitting diodes 112 acting as illumination assembly means to provide localized sources of light to be transmitted through diffuser block 50. Type LTL-907PK (red) will serve for LED status indicators 22, if they are surrounded by an opaque tube to prevent their light from being transmitted into block 50. As best seen in FIG. 3*a*, both electrostatic discharge shield 88 and domeseal 96 lie below an illumination portion 114 of light emitting diodes 112.

Figure 7:
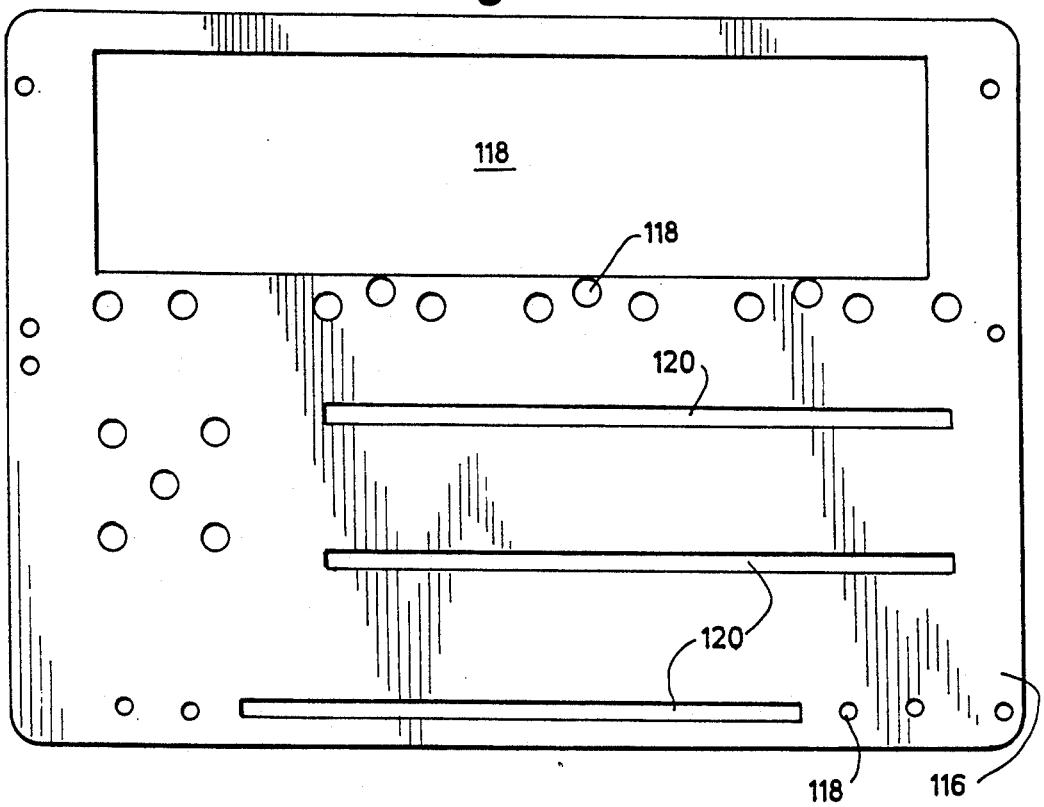
FIG. 7 is a top view of stencil of components shown in FIG. 3.

FIG. 7 provides an illustration of stencil outline 116 for both the electrostatic discharge shield 88 and domeseal 96 including excised areas 118 to be registered with both communication orifices 58 and LCD window 60. LED excised areas 120 are brought into registration with LED's 112 which are generally associated with key pads 24.

Light generated by LED'S 112 is generally transmitted upwards through block 50 to overlay 12. If the light impinges on a translucent area 34 of overlay 12, it provides a perceptible back lighting for panel 10 viewed from distal side 42 of overlay 12. If the light generated by LED's 112 does not impinge on a translucent area it is blocked by overlay reflective portion 38 and reflected away from overlay 12. Reflected light cannot exit block 50, except through illumination side 54, since it is reflected by block reflective surface 64 on perimeter edges 56 and LCD window perimeter edge 122. Light reflected downward towards printed circuit board 104 is re-reflected upwards by aluminum foil 90 of electrostatic discharge shield 88, serving as illumination reflecting means reflecting light towards the diffuser block 50. Matte diffusing surfaces and multiple reflections of relatively low intensity light each promote relatively uniform back lighting while avoiding glare.

Figure 8:
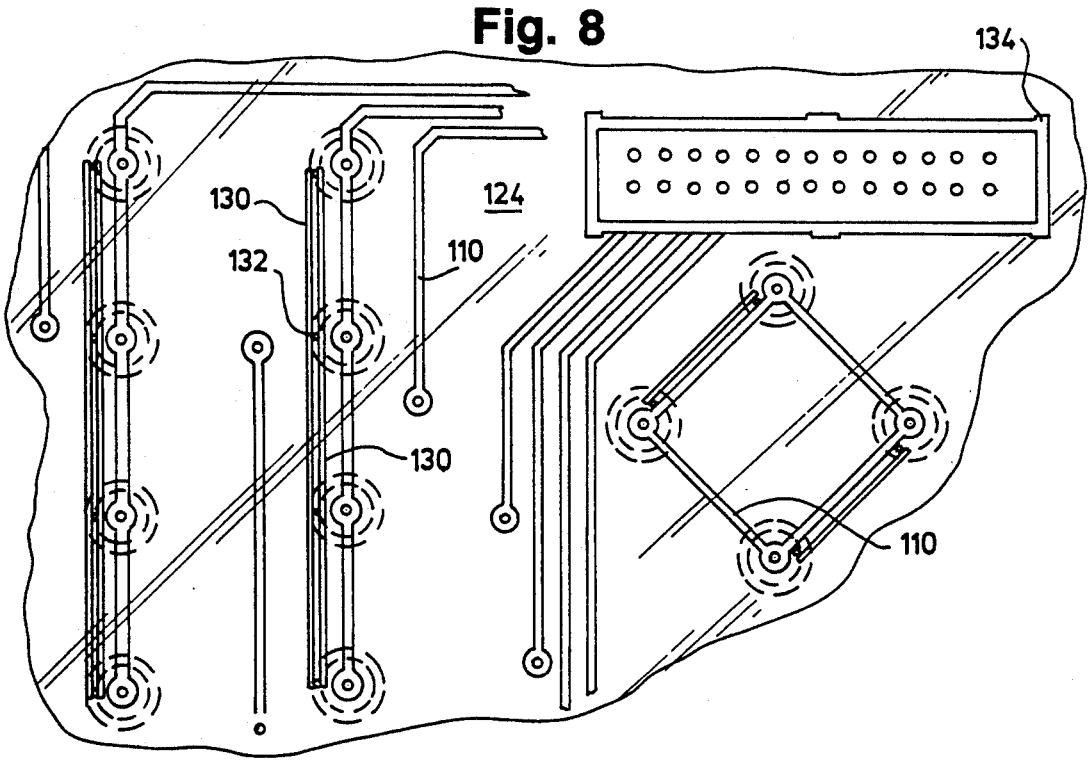
FIG. 8 is a partial bottom view of the data display control panel shown in FIG. 1.

Generally, the bottom most layer of panel 10 is backseal 124 having an adhesive layer 126 adhering to a plastic film layer 128 to the bottom, or rear, of printed circuit board 104. Backseal 124 may be the same material as domeseal 96 and provides, as its name implies, a dirt impermeable reservoir on the bottom of printed circuit board 104. Backseal 124 and domeseal 96 each have a 0.0008 inch layer of acrylic adhesive on a 0.002 inch MYLAR film. In addition to preventing cross tracking between separate tracks of bottom foil 110, backseal 124 serves to close a channel between parallel channel tracks 130 connecting through holes 132. Through holes 132 connect the bottom of printed circuit board 104 to the underside of domeswitch contacts 102. This arrangement prevents entrapment of air beneath domeswitch contacts 102 while preventing their contamination. The volume of air which is displaced by the depression of domeswitch contact 102 is relatively small. Through holes 132 need only be 0.031 inch in diameter. Parallel tracks 130 are separateed by 0.040 inch. As further shown in FIG. 8, terminal connector 134 allows connection of the various front 106 and bottom 110 foil tracks to associated components.

The relative thinness of the various components assist in achieving a panel 10 which is relatively thin. Overlay 12 is about 0.009 inch thick. Diffuser bock 50 is about 0.250 inch. Electrostatic discharge shield 88 is about 0.003 inch thick as are domeseal 96 and backseal 124. Printed circuit board 104 is only about 0.032 inch thick for panels 10 which are about 0.300 inch thick. If additional resistance to vertical loads is needed a 0.125 inch thick printed circuit board should resist all but the most severe abuse.

As those skilled in the art will readily recognize, some of the invention elements may be interchanged, for example those shown as integral may be separated or those separated may be made integral without adversely affecting the performance of the invention.

From the foregoing description it will be apparent that modifications can be made to the control panel of the present invention without departing from the teaching of the invention. Also it will be appreciated that the invention has a number of advantages, some of which have been described above and others of which are inherent in the invention. Accordingly, the scope of the invention is only to be limited as is necessitated by the accompanying claims.

We claim:

1. A thin data display control panel comprising:

a graphic overlay of generally opaque hue but having translucent areas passing through a most thin dimension of said overlay, and generally having an overlay reflective portion on a diffuser side of said overlay, said reflective area not contiguous to said translucent areas, said overlay having a distal side opposite to said diffuser side and generally parallel to said diffuser side;

a diffuser block affixed to said graphic overlay so that said diffuser side of said overlay is adjacent to a graphic side of said block, said diffuser block being generally transparent but having a first matte diffusing surface on said graphic side of said block through which surface light is transmitted towards said graphic overlay opposite an illumination side parallel to said graphic side; and illumination assembly means for providing a plurality of localized sources of light which are transmitted through said diffuser block in a diffuse manner and evenly illuminate only the translucent portions of said overlay when viewed from the distal side of said overlay.

2. The data display control panel of claim 1 further including:

said block having a block reflective surface being at least a semi-reflective coating generally adjacent at least perimeter edges joining said graphic and illumination sides of said block.

3. The data display control panel of claim 1 wherein said diffuser block further includes a second matte diffusing surface on said illumination side of said block.

4. The data display control panel of claim 1 further including:

a printed circuit board to which said illumination assembly means is mounted; and wherein said illumination assembly means is a plurality of light emitting diodes.

5. The data display control panel of claim 4 wherein said light emitting diodes each have a half angle off axis intensity at which a luminous intensity emitted by each said diodes falls to one half the axial intensity in excess of thirty degrees.

6. The data display control panel of claim 5 wherein said half angle is about seventy degrees and luminous intensity is about two milli-candela.

7. The data display control panel of claim 6 wherein said light emitting diodes are surface mounted to said printed circuit board.

8. The data display control panel of claim 4 further including:

an illumination reflecting means adjacent said printed circuit board for reflecting light towards said diffuser block.

9. The data display control panel of claim 8 wherein:

said illuminating reflecting means is aluminum foil carried on a film placed between an illumination portion of said light emitting diodes and a front side of said printed circuit board nearest to said diffuser block;

said light emitting diodes each are surface mounted to said front side and said diode have a half angle off axis intensity at which a luminous intensity emitted by each said diodes falls toone half the axial intensity in excess of thirty degrees.

10. The data display control panel of claim 3 wherein said overlay reflective portion is a metallic ink.

11. The data display control panel of claim 2 wherein said block reflective surface is white ink applied to the perimeter edges of said block with a coat of black ink overlying said white ink; and said overlay reflective portion is a metallic ink.

12. The data display control panel of claim 1 wherein said illumination side of said diffuser block further includes:

a base portion; and a recessed portion closer to said graphic side than said base portion is, which recessed portion partially receives said illumination assembly means.

13. The data display control panel of claim 4 further including a plurality of switches arranged in arrays; and wherein said illumination side of said diffuser block further includes, a base portion adjacent a front side of said printed circuit board including base perimeter portions adjacent perimeter edges of said diffuser block and base key portions adjacent said switches; and a recessed portion spaced away from said front side of said printed circuit board and closer to said graphic side than said base portion is, which recessed portion partially receives said light emitting diodes.

14. The data display control panel of claim 13 wherein said base key portions are peninsulas joined to said base perimeter portions.

15. The data display control panel of claim 14 further including:

a liquid crystal display assembly;

a LCD window to the interior of said perimeter edges of said diffuser block, said window having window edges extending between said graphic and illumination sides, said window edges and said perimeter edges having a block reflective surface, said LCD window partially receiving said liquid crystal display assembly; and said graphic overlay having a transparent portion through which said liquid crystal display is viewable.

16. A data display control panel comprising:

a backseal film being generally dirt impermeable;

a printed circuit board including foil for switch contacts, and power leads on a front side of said printed circuit board, and having at least one through breather- hole in the vicinity of each switch contact termination, said backseal film adhered to a back side of said printed circuit board to form a dirt impermeable reservoir;

a dome switch contact being dome shaped and having the dome interior communicating with at least one breather hole;

a domeseal film affixed to said printed circuit board to positively located said dome switch on said front of said printed circuit board;

a plurality of light emitting diodes surface mounted to said front of said printed circuit board and emitting light in a emitting direction normal to said front and away from said printed circuit board;

electrostatic discharge shield foil means for dissipating electric charge away from said switches and reflecting light, said shield foil means including a film carrier carrying conductive light reflecting foil, said shield foil means generally passing over said domeseal film to the side away from said printed circuit board but excised in the area of each of said plurality of light emitting diodes to allow light to be transmitted in said emitting direction;

a diffuser block having a graphic side, and an illumination side and perimeter edges joining said graphic and illumination sides, said illumination side facing said front of said printed circuit board and receiving emitted light from said light emitting diodes, said illumination side including a base portion closely adjacent to said front of said printed circuit board and a recessed portion spaced away from said base portion in the emitting direction, said graphic side generally having a matte diffusing surface, said illumination side generally having a matte diffusing surface at least on said recessed portion, said block having a block reflective surface on said edges being a white coat of white ink and said white coat receiving a black coat of black ink, said diffuser block defining a plurality of communication orifices between said graphic and illumination sides, said diffuser block affixed to said printed circuit board;

a switch plunger occupying one of said communication orifices located adjacent said dome switch and extending at least beyond said graphic side in the emitting direction, said plunger being generally transparent; and a graphic overlay affixed to said graphic side of said diffuser block, said overlay being generally opaque but having translucent portions illuminated by light generated by said light emitting diodes and passing through said diffuser block, said overlay selectively reflecting and receiving light transmitted through said diffuser block at a diffuser side of said overlay by generally having a diffuser reflective surface on said diffuser side except in a area adjacent said translucent portions so that light is only transmitted through said overlay in the translucent portions to be viewable from a distal side opposite said diffuser side and light not transmitted through said overlay is trapped among said diffuser reflective surface, said conductive light reflective foil and said block reflective surface.

17. An back lighted data control panel comprising:

a display graphic overlay which is partially translucent in preselected viewing areas, said overlay having a display surface perceptible to a viewer and a diffuser surface;

a diffuser plate having a first display surface closest to said display graphic overlay and a second illumination surface;

a plurality of illumination sources of relatively low intensity disposed to said second illumination surface side of said diffuser plate;

a graphic reflector interposed between said display graphic overlay and said diffuser plate reflecting light back into said plate which is not transmitted through the translucent areas of said graphic overlay; and an illumination reflector interposed between said diffuser plate and said plurality of illumination sources reflecting light back into said diffuser plate, whereby the illumination levels at the display surface of said graphic overlay are relatively uniform while avoiding glare in a relatively thin cross section through said diffuser as a result of the multiple reflections through said diffuser.

18. The data control panel of claim 17 wherein said diffuser plate has a first display matte surface closest to said display graphic overlay.

19. The date control panel of claim 18 wherein said diffuser has a second illumination matte surfaces closest to said illumination sources.

20. The data control panel of claim 19 further including a first display matte surface closest to said display graphic overlay.

21. The data control panel of claim 20 wherein light is transmitted from said graphic reflector through said first graphic matte surface into said diffuser plate, from aid diffuser plate through said second illumination matte surface to said illumination reflector, where the light is reflected through said second illumination matte surface through said diffuser and out through said first graphic matte surface plate.

* * * * *